US006203270B1

(12) United States Patent
Magoshi

(10) Patent No.: US 6,203,270 B1
(45) Date of Patent: Mar. 20, 2001

(54) METHOD OF TRANSPORTING A STEAM TURBINE AND A DEVICE FOR AIDING THE TRANSPORTATION OF A STEAM TURBINE

(75) Inventor: Ryotaro Magoshi, Takasago (JP)

(73) Assignee: Mitsubhisi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/431,661

(22) Filed: Nov. 1, 1999

(51) Int. Cl.[7] ..... F01D 25/24; F01D 25/28
(52) U.S. Cl. ..... 415/126; 415/213.1; 29/889.1
(58) Field of Search ..... 415/126, 213.1, 415/214.1, 912; 29/889.1; 248/68.1, 74.1

(56) References Cited

U.S. PATENT DOCUMENTS 4,928,911 * 5/1990 Hardtke ..... 248/74.1
4,951,902 * 8/1990 Hardtke ..... 248/74.1

* cited by examiner

*Primary Examiner*—Christopher Verdier
(74) *Attorney, Agent, or Firm*—Wallenstein & Wagner, Ltd.

(57) ABSTRACT

There is provided a device for aiding transportation of a steam turbine which includes a rotor extending along a longitudinal axis and having multistage stationary and moving blades, a casing, supported by a base structure, for enclosing the rotor, bearings for rotationally supporting the rotor, and a pair of glands for sealing between the casing and the rotor, the casing including longitudinally opposite side flanges, the glands being mounted onto gland portions which are provided on the respective sides of the rotor outside of the casing and attached to the respective side flanges of the casing through a pair of flexible members, the device includes restrainers which are adapted to replace the glands after the glands are removed from the rotor and the casing. The restrainers are fitted onto the rotor where the glands had been mounted, and secured to the side flanges of the casing whereby the rotor and the casing are connected to each other to limit the relative movement therebetween and the restrainers bear the weight of the rotor with the bearings.

8 Claims, 5 Drawing Sheets

METHOD OF TRANSPORTING A STEAM TURBINE AND A DEVICE FOR AIDING THE TRANSPORTATION OF A STEAM TURBINE

FIELD OF THE INVENTION

The invention relates to a method of transporting a steam turbine and a device for aiding the transportation of a steam turbine.

DESCRIPTION OF THE RELATED ART

In general, a steam turbine includes a rotor and a casing for enclosing the rotor. A pair of bearing boxes, which enclose bearings for rotationally supporting the opposite ends of the rotor, are provided on the opposite end portions of the rotor.

The casing includes a steam inlet through which steam is directed to turbine portions which are symmetrically provided on either side of the rotor. Each of the turbine portions includes multistage stationary and moving blades provided around and along the rotor.

In the prior art, in order to transport a steam turbine, the steam turbine must be disassembled because the rotor is not rigidly connected to the casing so that a relational movement between the casing and rotor is caused when the assembled steam turbine is lifted for transportation.

SUMMARY OF THE INVENTION

The invention is directed to solve the above mentioned prior art problems, and the objective of the invention is to provide an improved method of transporting a steam turbine, and a device for aiding the transportation of a steam turbine which allow the steam turbine to be transported without disassembling the turbine.

The invention provides a method of transporting a steam turbine which includes a rotor extending along a longitudinal axis and having multistage stationary and moving blades, a casing, supported by a base structure, for enclosing the rotor, bearings for rotationally supporting the rotor, and a pair of glands for sealing between the casing and the rotor, the casing including longitudinally opposite side flanges, the glands being mounted onto gland portions which are provided on the respective sides of the rotor outside of the casing and attached to the respective side flanges of the casing through a pair of flexible members. The method comprises the steps of removing the glands from the rotor; mounting restrainers to the rotor where the glands had been mounted and to the side flanges of the casing whereby the rotor and the casing are connected to each other to limit the relative movement therebetween and the restrainers bear the weight of the rotor with the bearings; and transporting the casing and the rotor with the bearings coupled to the rotor.

According to another feature of the invention, there is provided a device for aiding transportation of a steam turbine which includes a rotor extending along a longitudinal axis and having multistage stationary and moving blades, a casing, supported by a base structure, for enclosing the rotor, bearings for rotationally supporting the rotor, and a pair of glands for sealing between the casing and the rotor, the casing including longitudinally opposite side flanges, the glands being mounted onto gland portions which are provided on the respective sides of the rotor outside of the casing and attached to the respective side flanges of the casing through a pair of flexible members. The device comprises restrainers which are adapted to replace the glands after the glands are removed from the rotor and the casing. The restrainers are fitted onto the rotor where the glands had been mounted, and secured to the side flanges of the casing whereby the rotor and the casing are connected to each other to limit the relative movement therebetween and the restrainers bear the weight of the rotor with the bearings.

According to the invention, when lifting the steam turbine, the restrainers radially and axially hold the rotor and bear the weight of the rotor and the bearing boxes.

DESCRIPTION OF THE DRAWINGS

These and other objects and advantages and further description will now be discussed in connection with the drawings in which.

DESCRIPTION OF THE PREFERRED EMBODIMENTS

Figure 6:
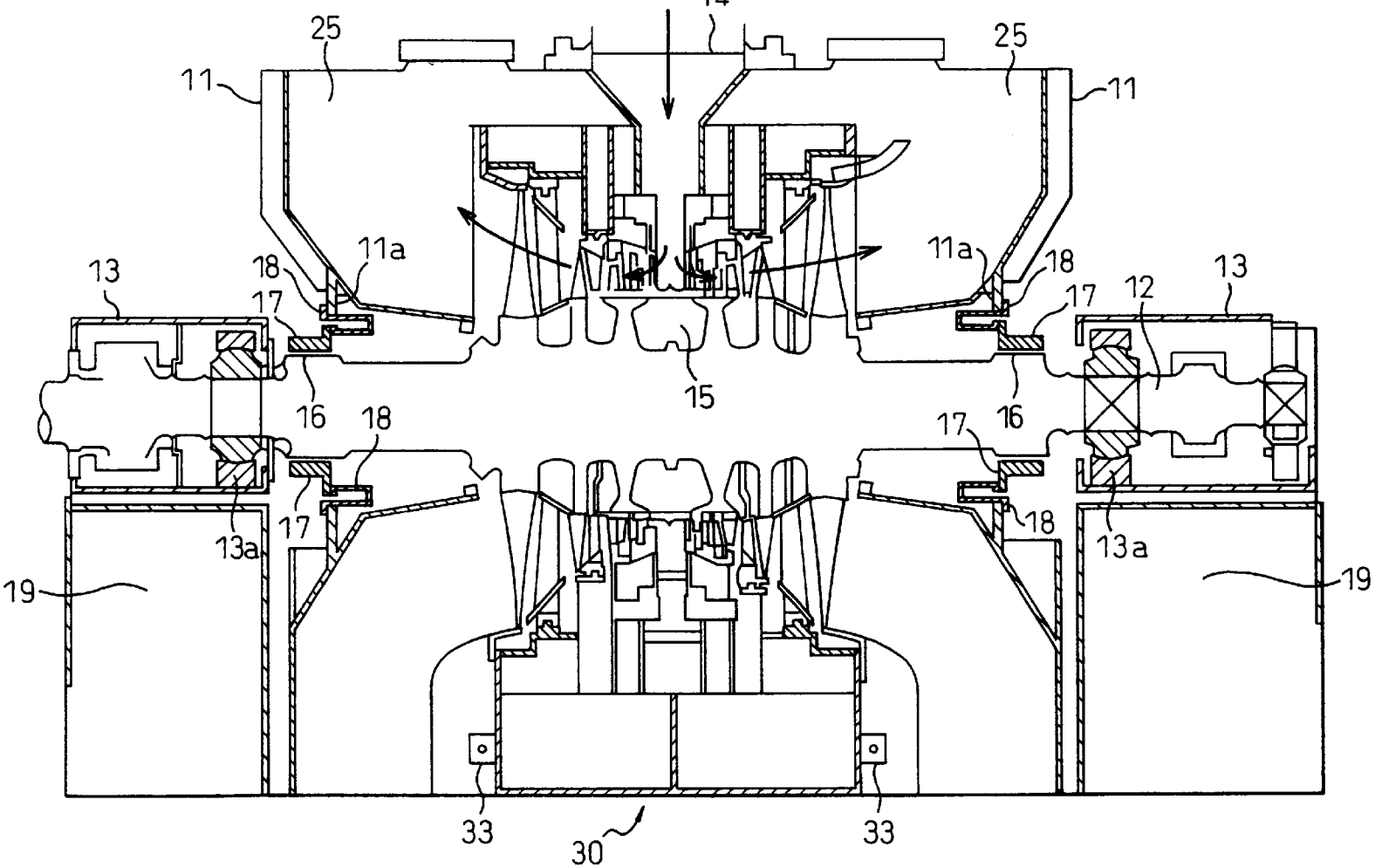
FIG. 6 is a cross sectional view of the steam turbine which has been installed for normal operation.

FIG. 6 shows a general sectional view of a steam turbine to which the present invention is applied. In particular, FIG. 6 shows, as an example, a low pressure steam turbine which has been installed for normal operation.

The low pressure steam turbine includes a rotor 12 which extends along the longitudinal axis of the steam turbine. The low pressure steam turbine further includes a casing 11 for enclosing the rotor 12. The opposite end portions of the rotor 12 extend from the casing 11. A pair of bearings 13*a* are mounted on platforms 19 and rotationally support the opposite end portions of the rotor 12 outside of the casing 11. Bearing boxes 13 for enclosing the bearings 13*a* are also mounted on the platform 19.

The casing 11 is supported by a base structure 30 which is provided underneath of the casing 11 and includes a plurality of brackets 33. The casing 11 and the base structure 30 are connected to each other.

The casing 11 includes a steam inlet 14 through which a low pressure steam is directed to turbine portions 15 which are symmetrically provided on either side of the rotor 12. Each of the turbine portions 15 includes multistage stationary and moving blades provided around the rotor 12.

Figure 5:
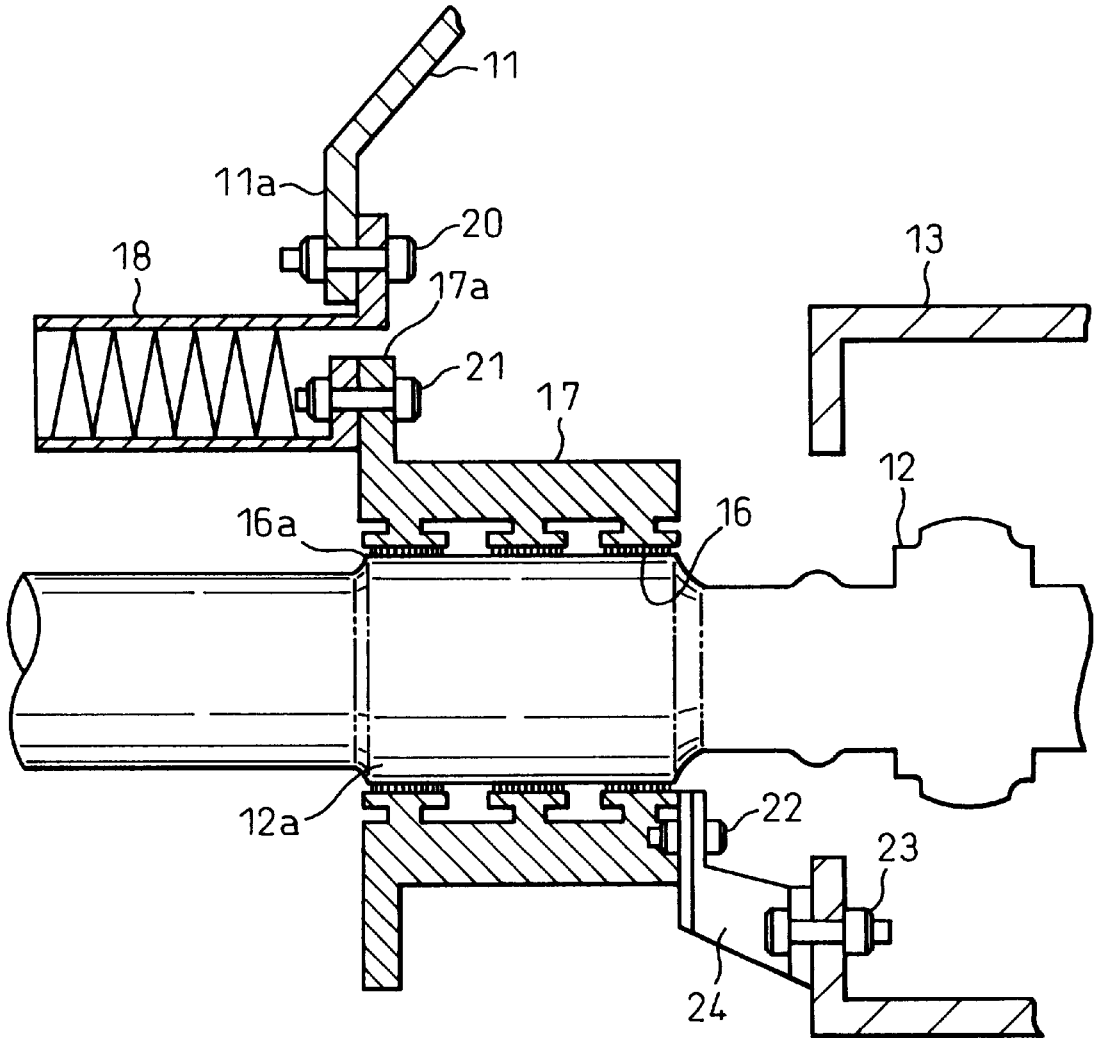
FIG. 5 is a cross sectional view of a gland mounted to the rotor and casing of the steam turbine shown in FIG. 1.

With reference to FIG. 5, a gland 17 is provided on each side of the rotor 12 outside of the casing 11 where the rotor 12 has thick portions 12*a* referred to as gland portions in this specification. The gland 17 includes labyrinth seal 16, as known in the art. The gland 17 is connected to the side flange 11*a* of the casing 11 through flexible bellows member 18 which is attached to the side flange 11*a* of the casing 11 by bolts 20 and to a flange portion 17*a* of the gland 17 by bolts 21. The gland 17 is further connected to the bearing box 13 through bracket 24 which is attached to the gland 17 by bolts 22 and to the bearing housing 13 by bolts 23.

Although the detailed configuration of the gland 17 is not shown in the drawings, in order to facilitate the attachment and detachment of the gland 17 to and from the rotor 12, the gland 17 consists of two halves which are joined to and separated from each other at a longitudinally extending parting line, as well known in the art.

As described above, the gland 17 is connected to the side flange 11*a* of the casing 11 through the flexible bellows members 18. Therefore, if the assembly of the low pressure steam turbine is lifted for transportation with the bearing boxes 13 coupled to the ends of the rotor 12, the rotor 12 moves radially and axially from the appropriate position and bends itself due to the weight of the rotor 12 and the bearing boxes 13 since the flexible bellows members 18 cannot bear the weight. In the prior art, this forces the manufacturer, installer or maintenance operators of the low pressure steam turbine to disassemble it for transportation.

Figure 1:
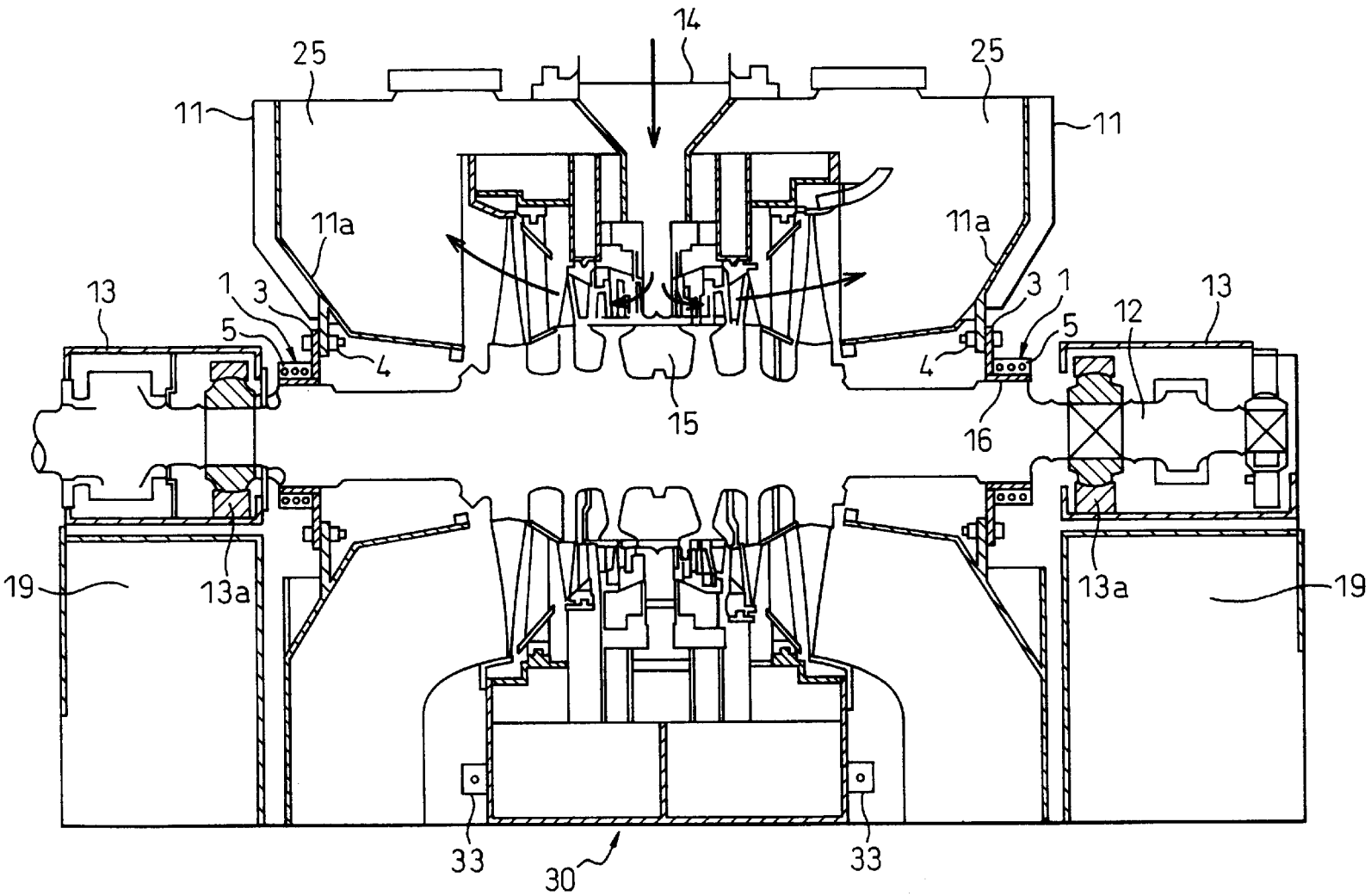
FIG. 1 is a general sectional view of a steam turbine with a device for aiding the transportation of the turbine according to the preferred embodiment of the present invention.
Figure 2:
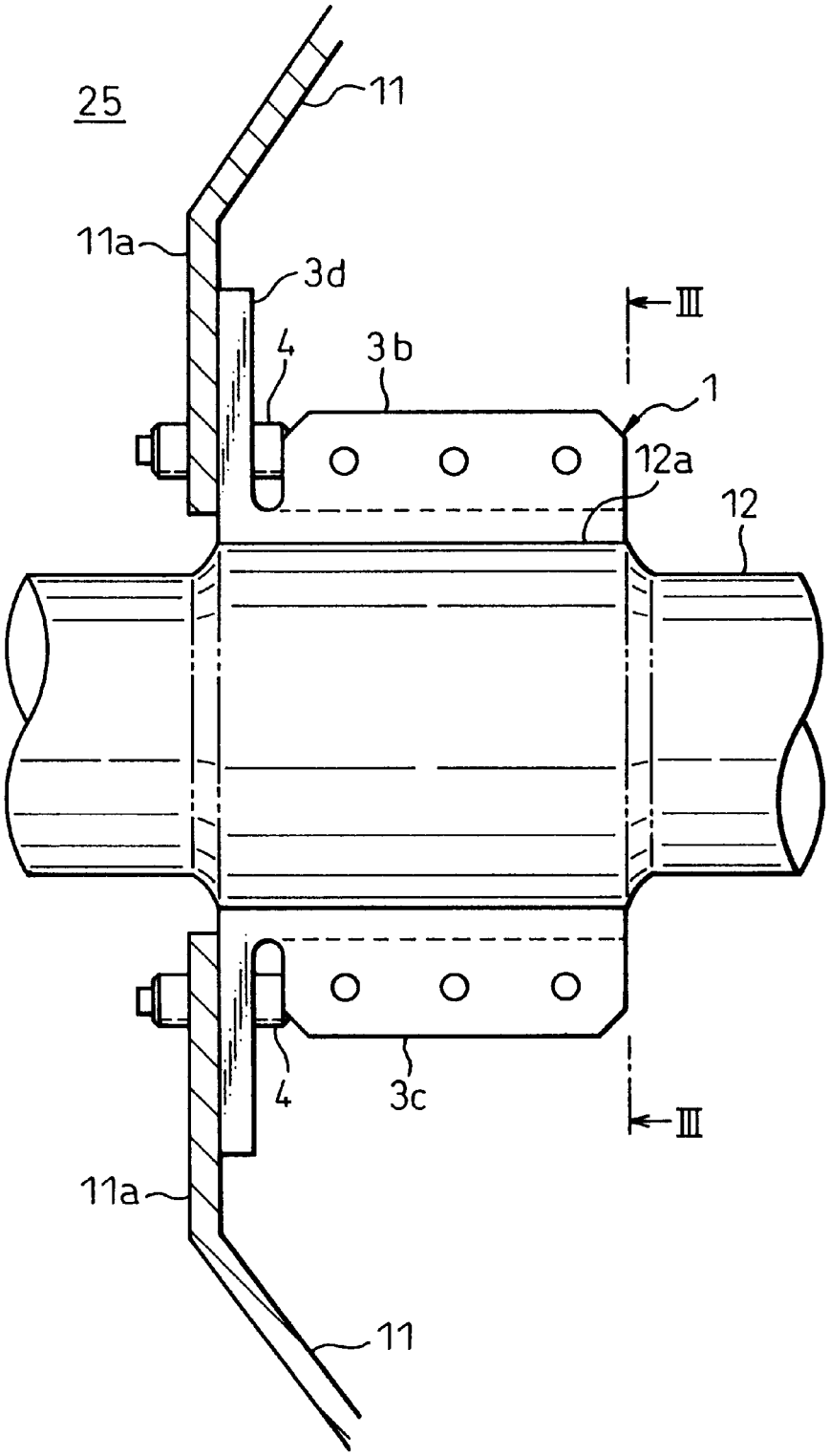
FIG. 2 is enlarged sectional view of the aiding device of the preferred embodiment of the present invention along line II—II in FIG. 3, the device mounted between a casing and a rotor of the steam turbine shown in FIG. 1.
Figure 3:
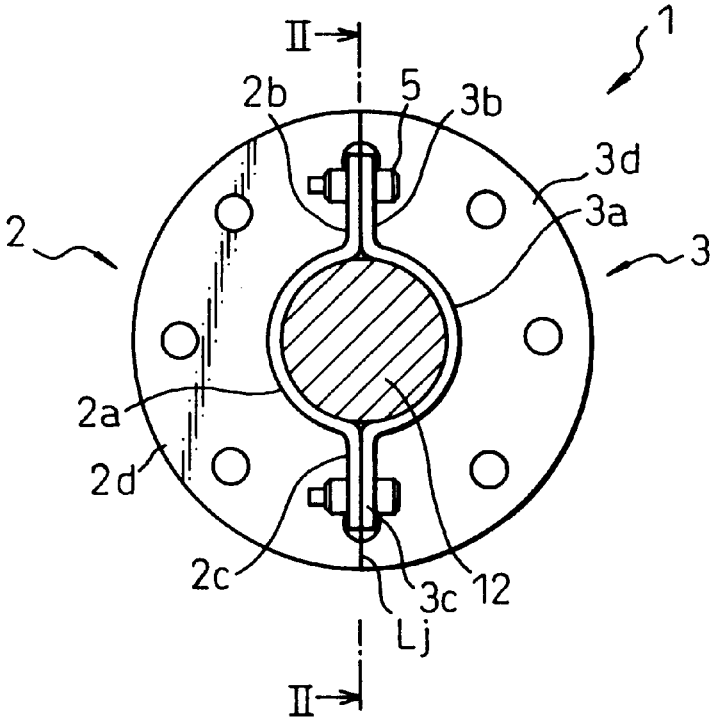
FIG. 3 is an end view of the aiding device along line III—III in FIG. 2.

According to the invention, the glands 17 are replaced with restrainers 1, as shown in FIGS. 1, 2 and 3, when the low pressure steam turbine is transported.

The restrainer 1 includes first and second halves 2 and 3 which are joined at a longitudinally extending parting line $L_j$. The first and second halves 2 and 3 include half cylinder body portion 2*a* and 3*a*. When the first and second halves 2 and 3 are connected to each other, the half cylinder body portions 2*a* and 3*a* define a cylindrical main body of the restrainer 1 which is adapted to be fitted onto the gland portion 12*a* of the rotor 12. Each of the first and second halves 2 and 3 further includes a pair of radial flanges 2*b*, 2*c*, 3*b* and 3*c* which are diametrically extending from the longitudinal edges of the half cylinder body portions 2*a* and 3*a* and an end flange portion 2*d* and 3*d* connected to one end of the half cylinder body portions 2*a* and 3*a*.

The operation of the low pressure steam turbine according to the embodiment will be described as follows.

Before the low pressure steam turbine is transported, the flexible bellows members 18 are detached from the side flanges 11*a* of the casing 11 and the glands 17 by removing the bolts 20 and 21. Then, the glands 17 are disconnected from the brackets 24 by removing the bolts 21. The brackets 24 may also detached from the bearing boxes 13 by removing bolts 23. The glands 17 are disassembled into the halves at the longitudinal parting line to detach from the rotor 12.

The restrainers 1 are mounted to the rotor 12 by assembling the first and second halves 2 and 3 to each other at the longitudinal parting line Lj, so that the main bodies of the restrainers 1 are fitted onto the gland portions 12*a* of the rotor 12, as shown in FIGS. 2 and 3. The first and second halves 2 and 3 are securely connected to each other, by tightening the bolts 5 extending through the radial flanges 2*b*, 2*c*, 3*b* and 3*c*, to clamp the gland portion 12 therebetween. At the same time, the assembled restrainers 1 are connected to the side flanges 11*a* of the casing 11 by tightening the bolts 5 extending through the side flanges 11*a* of the casing 11 and the end flanges 2*d* and 3*d* of the assembled restrainers 1.

Figure 4:
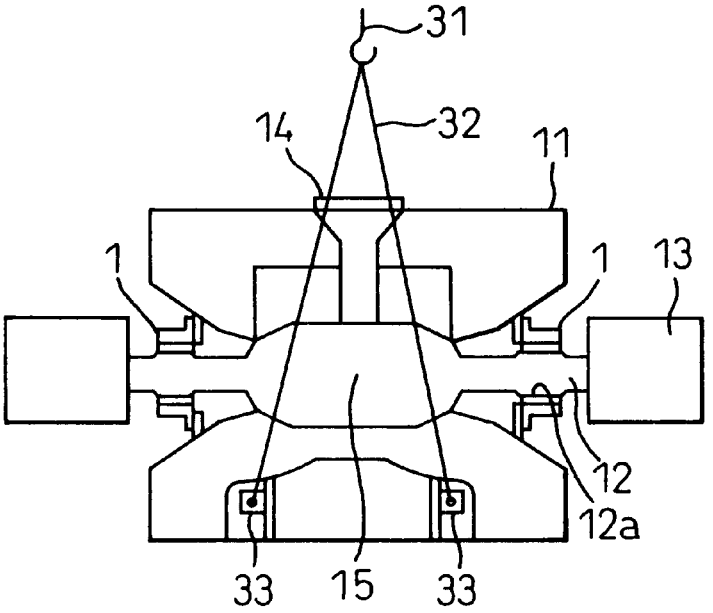
FIG. 4 is a general view of the steam turbine, in which the steam turbine is lifted for transportation.

Then, the low pressure steam turbine with the casing 11, rotor 12 and bearing boxes assembled is lifted with a crane (not shown) through a hook 31 and cables 32 which are attached brackets 33 of the support structure 30, as shown in FIG. 4. At lifting the low pressure steam turbine, the restrainers 1 radially and axially hold the rotor 12 and bear the weight of the rotor 12 and the bearing boxes 13.

It will also be understood by those skilled in the art that the forgoing description is a preferred embodiment of the disclosed invention and that various changes and modifications may be made without departing from the spirit and scope of the invention.

We claim:

1. A method of transporting a steam turbine which includes a rotor extending along a longitudinal axis and having multistage stationary and moving blades, a casing, supported by a base structure, for enclosing the rotor, bearings for rotationally supporting the rotor, and a pair of glands for sealing between the casing and the rotor, the casing including longitudinally opposite side flanges, the glands being mounted onto gland portions which are provided on the respective sides of the rotor outside of the casing and attached to the respective side flanges of the casing through a pair of flexible members, the method comprising the steps of:

removing the glands from the rotor;

mounting restrainers to the rotor where the glands had been mounted and to the side flanges of the casing whereby the rotor and the casing are connected to each other to limit the relative movement therebetween and the restrainers bear the weight of the rotor with the bearings; and transporting the casing and the rotor with the bearings coupled to the rotor.

2. A method of transporting a steam turbine according to claim 2, further comprising steps of:

attaching a cable to the base structure;

hooking the cable to a crane; and suspending the steam turbine to transport it.

3. A method of transporting a steam turbine according to claim 1, further comprising a step of removing the flexible members from the casing before the step of mounting the restrainers.

4. A method of transporting a steam turbine according to claim 1 in which each restrainer includes a cylindrical portion adapted to be fitted onto the rotor where the gland had been mounted and an end flange portion, connected to one end of the cylindrical portion, for mounting to the side flange of the casing.

5. A device for aiding transportation of a steam turbine which includes a rotor extending along a longitudinal axis and having multistage stationary and moving blades, a casing, supported by a base structure, for enclosing the rotor, bearings for rotationally supporting the rotor, and a pair of glands for sealing between the casing and the rotor, the casing including longitudinally opposite side flanges, the glands being mounted onto gland portions which are provided on the respective sides of the rotor outside of the casing and attached to the respective side flanges of the casing through a pair of flexible members, the device comprising:

restrainers which are adapted to replace the glands after the glands are removed from the rotor and the casing, the restrainers being fitted onto the rotor where the glands had been mounted, and secured to the side flanges of the casing whereby the rotor and the casing are connected to each other to limit the relative movement therebetween and the restrainers bear the weight of the rotor with the bearings.

6. A device according to claim 5 in which the base structure includes a plurality of brackets to which cables are attached for suspending the steam turbine.

7. A device according to claim 5 in which each restrainer includes a cylindrical portion adapted to be fitted onto the rotor where the gland had been mounted and an end flange portion, connected to one end of the cylindrical portion, for mounting to the side flange of the casing.

8. A device according to claim 7 in which each restrainer includes first and second halves which are joined at a longitudinally extending parting line, each of the first and second halves including half cylinder portions which define the cylindrical portion when the first and second halves are joined to each other.

* * * * *

UNITED STATES PATENT AND TRADEMARK OFFICE

CERTIFICATE OF CORRECTION

PATENT NO. : 6,203,270 B1
DATED : March 20, 2001
INVENTOR(S) : Ryotaro Magoshi

It is certified that error appears in the above-identified patent and that said Letters Patent is hereby corrected as shown below:

Title page,
Item [75], delete “Takasago” and insert -- Takasago-shi --.

Column 3,
Line 42, delete “also detached” and insert -- also detach --.

Column 4,
Line 26, delete “claim 2” and insert -- claim 1 --.

Signed and Sealed this

Eighth Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,203,270 B1
DATED : March 20, 2001
INVENTOR(S) : Ryotaro Magoshi

It is certified that error appears in the above-identified patent and that said Letters Patent is hereby corrected as shown below:

Title page,
Item [75], after the Inventor's name, delete "Takasago" and insert -- Takasago-shi --.
Item [73], Assignee, delete "Mitsubhisi" and insert -- Mitsubishi -- to correct the spelling of Assignee's name.

Column 3,
Line 42, delete "also detached" and insert -- also detach --.

Column 4,
Line 26, delete "claim 2" and insert -- claim 1 --.

Signed and Sealed this

Twenty-fifth Day of May, 2004

JON W. DUDAS
*Acting Director of the United States Patent and Trademark Office*